United States Patent [19]

Gross

[11] Patent Number: 5,044,284

[45] Date of Patent: Sep. 3, 1991

[54] COMPUTER WORKSTATION

[76] Inventor: Milton Gross, 34 Elmore Rd., Rochester, N.Y. 14618

[21] Appl. No.: 486,692

[22] Filed: Mar. 1, 1990

[51] Int. Cl.[5] ..... E06B 11/00

[52] U.S. Cl. ..... 108/10; 108/9; 248/242; 211/187

[58] Field of Search ..... 108/138, 10, 3, 5, 6, 108/9, 95, 96, 106, 144; 211/150, 187, 209; 248/242

[56] References Cited

U.S. PATENT DOCUMENTS

| | | | |
|---|---|---|---|
| 2,931,685 | 1/1958 | Butler | 108/144 |
| 4,365,561 | 12/1982 | Tellier et al. | 108/96 |
| 4,515,085 | 5/1985 | Kwiecinski . | |
| 4,567,835 | 2/1986 | Reese . | |
| 4,640,199 | 2/1987 | Zigman | 108/6 |
| 4,693,444 | 9/1987 | Williams . | |
| 4,725,106 | 2/1988 | Shields . | |
| 4,779,922 | 10/1988 | Cooper . | |

OTHER PUBLICATIONS

Collection of 1988 & 1989 catalog pages showing Computer Workstations.

*Primary Examiner*—Kenneth J. Dorner
*Assistant Examiner*—Gerald A. Anderson
*Attorney, Agent, or Firm*—Martin Lukacher

[57] ABSTRACT

A computer workstation for supporting and positioning a computer and/or its video display terminal or screen and its keyboard at minimum fatigue locations. The computer and/or the video display terminal can be located at a desired elevations and tilted. The keyboard is supported on a keyboard shelf which can also be positioned at a desired elevation and tilted. The computer table and shelf are located between side wall panels of a frame having racks with slots at different elevations. Both the keyboard shelf and the computer table are pivotally mounted on members which can be positioned in different ones of the slots to select the elevation thereof. A belt connected at one end to the frame extends around a pulley under the computer table so as to support the table. The belt has holes which are engaged by a hook on a handle which is pivotally mounted to the bottom of the table. By pivoting the handle the length of the belt underneath the table can be changed thereby tilting the table. A stop pin is extended through a hole in the table into one of the holes in the belt thereby maintaining the table at a selected inclination or tilt. The keyboard shelf is connected by links to the side walls and may also be tilted. The center of the screen of the terminal and the keyboard may be located along the normal line of sight of the operator seated in front of the station for minimum fatigue for operators who may be tall or short. Arm rests may be pivotally mounted on the side walls so that they can be raised or lowered.

11 Claims, 6 Drawing Sheets

108
110
112
34
7-7
42
102
100
104
46
140
142
126
124
122
144
128
114
156
160
162
50
58
52
54
152
154
150

COMPUTER WORKSTATION

DESCRIPTION

The present invention relates to computer workstations and particularly to a workstation for supporting a computer and/or its video display terminal (VDT) and its keyboard so as to reduce operator fatigue which occurs after several hours of computer operation.

The invention is especially suitable for providing a computer workstation which reduces neck and vertebrae pain, wrist pain and eye strain, particularly for persons wearing bifocal corrective lenses. Such neck strain may be caused by repeated up and down movement of the head as the operator repeatedly looks from the keyboard to the screen. Wrist pain is usually caused by the keyboard being at an improper height with respective to the operator's shoulders and may also be due to the lack of arm rests. Eye strain may be caused by repeated changes in focus that the eye is forced to make when the line of sight from the operator's eyes is changed from near the keyboard to the screen.

It is the principal object of this invention to provide a computer workstation which meets the objectives of human engineering such as stated in the military standard for human engineering design criteria which are defined as providing equipment and facilities which provide work environments which foster effective procedures, work patterns, and personal safety and health, and which minimizes factors which degrade human performance or increase errors.

It is a further object of the invention to provide an improved computer workstation of a design such that operator work load, accuracy, time constraints, mental processing and communications requirements do not exceed operator physical body tolerances (see MIL-STD-1472C Section 4.1).

Computer workstations which have heretofore been provided have subjected operators to fatigue which occurs after several hours of being seated in front of a computer. This fatigue is manifested as neck and vertebrae pain, wrist pain syndrome and eye strain especially when the operator is wearing bifocal lenses. Neck strain is caused by repeated up and down movement of the head as the operator repeatedly looks from the keyboard to the terminal screen which is usually well above eye level. Wrist pain is caused by the improper height of the keyboard with respect to the operator's shoulders and is exacerbated by the lack of arm rests. Eye strain is caused in part by repeated changes in focus that the eye is forced to accomplish when the line of sight is changed from near the keyboard to the screen of the VDT. Even where complex adjustment mechanisms have been proposed, such as complex linkages and seat adjustments (see Cooper U.S. Pat. No. 4,779,922, Oct. 25, 1988 and Reese U.S. Pat. No. 4,567,835, Feb. 4, 1986) human engineering principles and objectives, as stated above, have not been accomplished. Most computer workstations are designed with the objective of low cost and are made out of particle board wherein the human engineering criteria and objectives stated above are not addressed. Moreover, the particle board systems are not sturdy because of the difficulty of connecting particle boards with conventional hardware such as screws.

The present invention provides an improved workstation where adjustments in elevation and tilt of a computer or a VDT can be made by the operator while seated at the workstation, such adjustments permitting the operator to position the VDT and the computer, and its keyboard into a configuration which minimizes operator visual and body fatigue even after long hours of concentrated work at the workstation. A feature of the invention is to provide a workstation with arm rests which may be raised or lowered thereby contributing to the minimization of operator fatigue.

Briefly described, a workstation for supporting a computer and/or a video display terminal which embodies the invention utilizes a frame having side walls and a back member extending between the side walls. Racks having a plurality of slots are mounted or the side walls. The slots of the racks are in alignment. A table is provided for supporting the terminal. Members, such as provided by the ends of a rod extending along an edge of the table project beyond the side edges of the table. The table is disposed between the side walls. The rod may be inserted in the slots of the rack to adjust the elevation of the table and to pivotally mount the table. A belt is connected at one end to the frame in back of the table and extends along and in supporting relationship with the bottom of the table. An adjusting mechanism changes the length of the belt under the table and adjusts the inclination of the table. The keyboard may also be mounted on a shelf which is pivotally mounted at a desired elevation in the racks. Links also connect the shelf to the side walls for adjusting the inclination of the keyboard shelf. Arm rests may be pivotally mounted in the side walls and raised or lowered. A backing panel may be disposed behind the keyboard table to locate the position of the VDT screen either forwardly or rearwardly and prevent the VDT from falling off the table if inadvertently inclined at an angle greater than the angle of repose (where it can slide off the table) on the table.

The foregoing and other objects, features and advantages of the invention as well, as the presently preferred embodiment thereof, will become more apparent from a reading of the following description in connection with the accompanying drawings in which.

Figure 1:
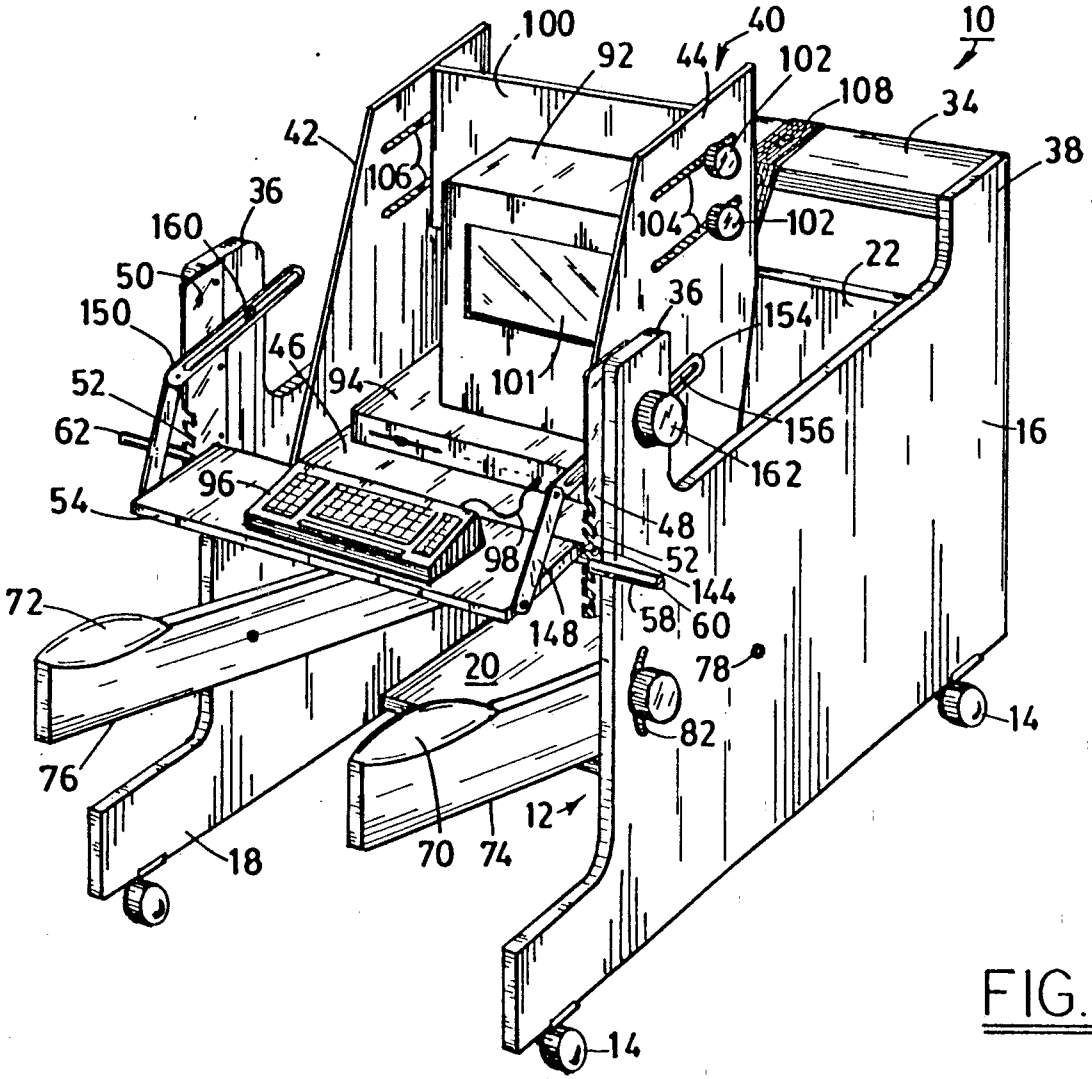
FIG. 1 is a perspective view of a computer workstation in accordance with a presently preferred embodiment of the invention.
Figure 2:
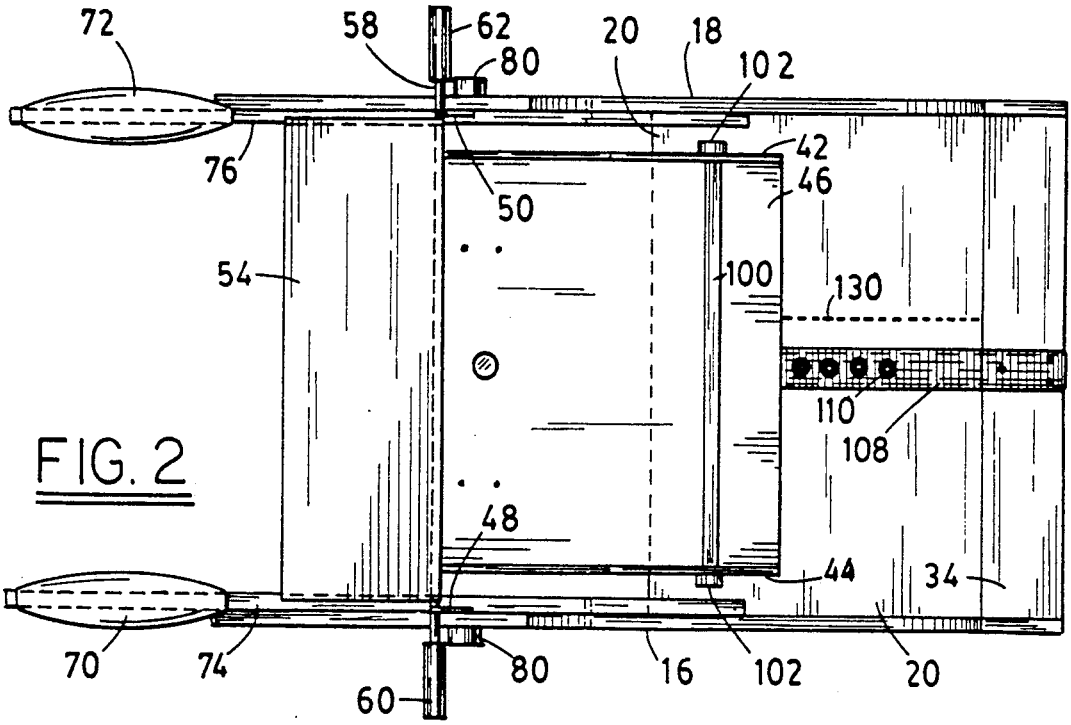
FIG. 2 is a plan view of the workstation shown in FIG. 1.
Figure 3:
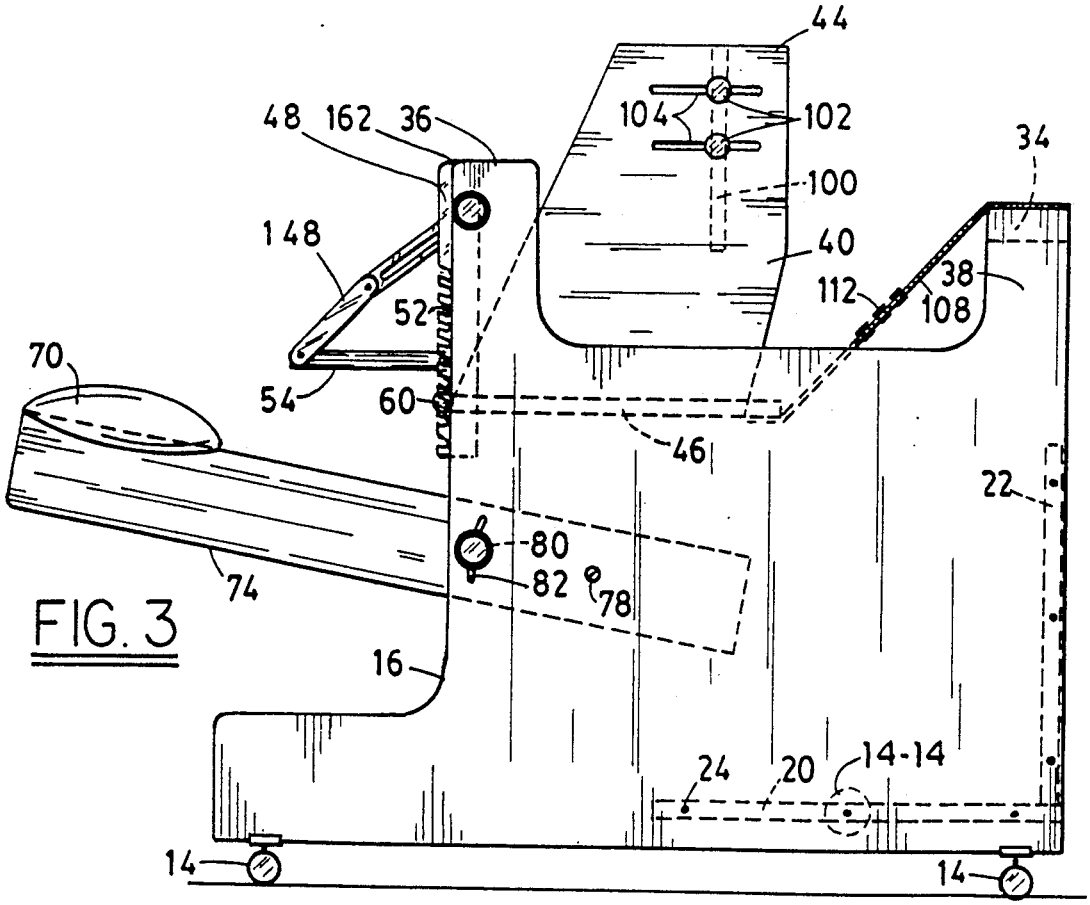
FIG. 3 is a side elevation of the workstation shown in FIG. 1.

Referring to FIGS. 1 through 4 there is shown a computer workstation generally indicated by reference numeral 10. The station has a frame 12 which is mounted on casters 14 on which the workstation can be rolled over the floor.

The frame 12 may be constructed essentially entirely of double faced particle board panels. There are side wall panels 16 and 18, a bottom panel 20 which extends along the bottom edges of the side wall panels to the rear edges thereof, and a back panel 22 which extends along the rear edges of the side wall panels. In spite of the frangible nature of particle board, these panels may be assembled by hardware in the manner shown in FIGS. 14, 15 and 16 which illustrates a typical connector assembly 24. This assembly includes a metal insert such as a dowel 26 inserted in a hole in the bottom panel 20. This dowel has a threaded hole 28. The hole faces the side wall 16. The bottom panel 20, like the back panel 22, has edges in abutment with the side walls. A bolt 30 extends through openings in the side wall 16 and the shelf 20, which pass through the interface therebetween where they abut, into threaded engagement with the dowel 26 in the threaded hole 28 therein. By tightening the bolt the side wall 16 is clamped to the bottom panel. The stresses on the particle board are distributed because of the large surface area of the dowel 26 and the large surface area under the head 32 of the bolt 30.

A beam 34 provides a back member which extends across the rear of the side walls 16 and 18 above the back panel 22. The side panels have legs 36 and 38 which define a U-shaped opening exposing the top of a computer table assembly 40. This assembly includes side panels 42 and 44 connected to a computer table 46.

The forward edges of the side walls 16 and 18 have racks 48 and 50. These racks have downwardly inclined slots 52. The slots in each rack are in alignment. These slots index the table assembly 40 at selected elevations, as well as pivotally support the computer table 46 and its assembly 40. They also support a keyboard shelf 54 at selected elevations.

Figure 9:
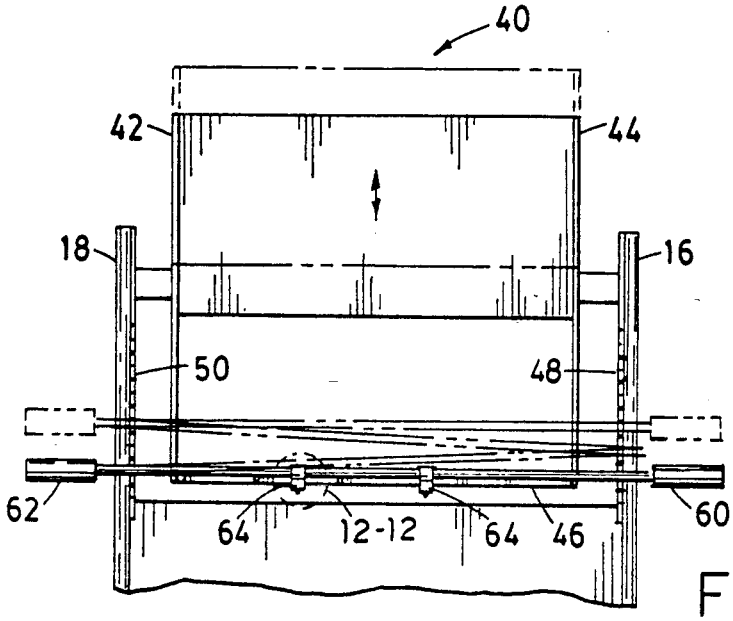
FIG. 9 is a fragmentary front elevation illustrating how the computer table may be raised or lowered.
Figure 12:
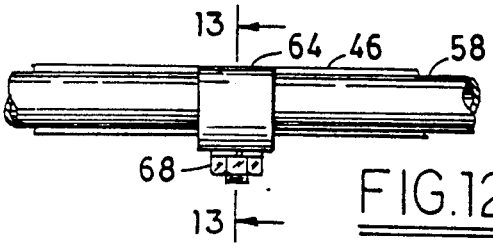
FIG. 12 is a fragmentary view of the front edge region of the computer table showing the elevation rod on which the table is pivotally mounted, and being of the region within the line 12—12 in FIG. 9.
Figure 13:
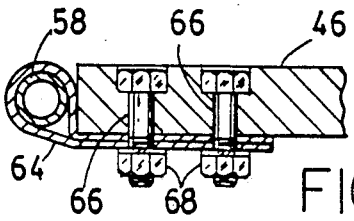
FIG. 13 is a fragmentary sectional view of the support rod and computer table, the view being taken along the line 13—13 in FIG. 12.

The computer table 46 is assembled with a rod 58 having portions 60 and 62 which extend beyond the side edges thereof. These portions may be covered by tubular grips also shown at 60 and 62. As shown in FIGS. 9, 12 and 13, the rod 58 may be fastened to the computer table 46 by clamp mechanisms 64 which extend around the rods and are connected to the table by bolts 66 and nuts 68.

Figure 17:
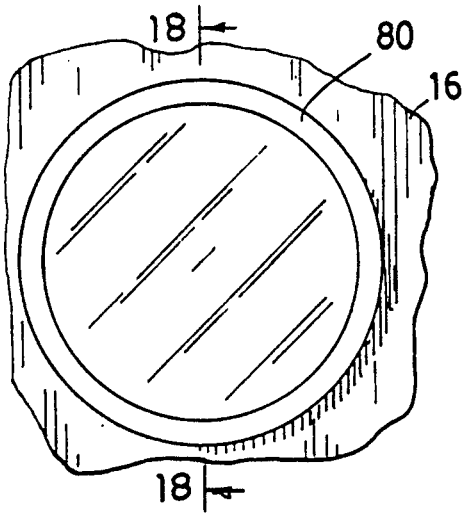
FIG. 17 is a fragmentary view of one of the knobs used to adjust one of the arm rests.
Figure 18:
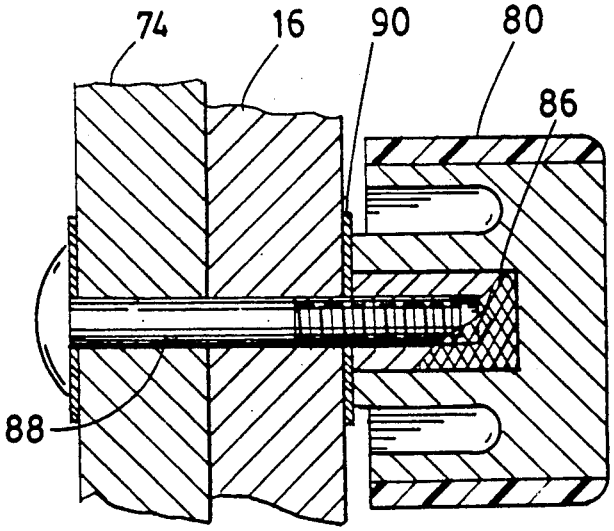
FIG. 18 is a fragmentary sectional view taken along the line 18—18 in FIG. 17.

Arm rests 70 and 72 of compliant material are mounted on struts 74 and 76. These struts are pivotally mounted on bolts 78 in the side walls 16 and 18. The arm rests may be independently raised or lowered by knobs 80 which extend through slots 82. These knobs 80 have knurled metal inserts 86 as shown in FIGS. 17 and 18. Bolts 88 extend through the struts and the side panels (for example the arm 74 and the side panel 16 as shown in FIG. 18) are threadedly engaged in the holes in the inserts 86. Washers 90 provide separation of the knobs 80 and the side panels. To adjust an arm rest, the knob 80 is loosened, which may be accomplished by the operator seated in front of the table. The arm rests are then adjusted and the knobs tightened so that the arm rests 70 and 72 are at the desired height to support the arms of the operator while working at the keyboard 54.

Figure 14:
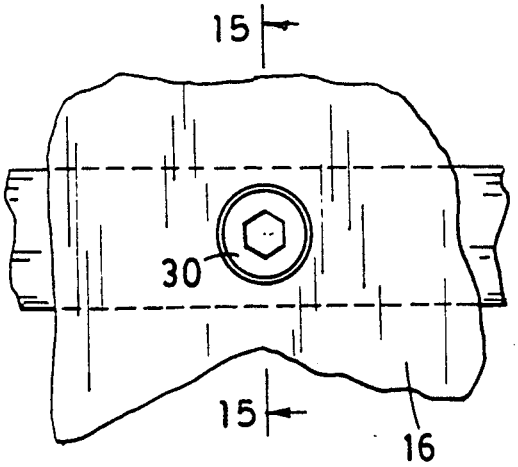
FIG. 14 is a fragmentary view of one of the side walls and the brace taken along the line 14—14 in FIG. 3.
Figure 15:
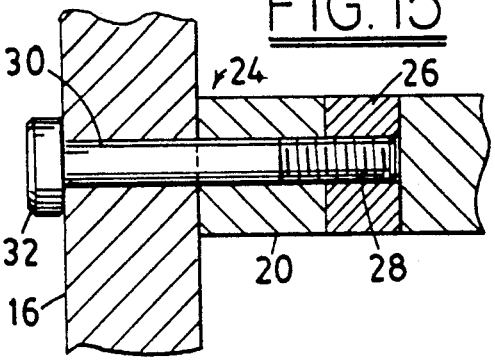
FIG. 15 is a fragmentary sectional view taken along the line 15—15 in FIG. 14.
Figure 16:
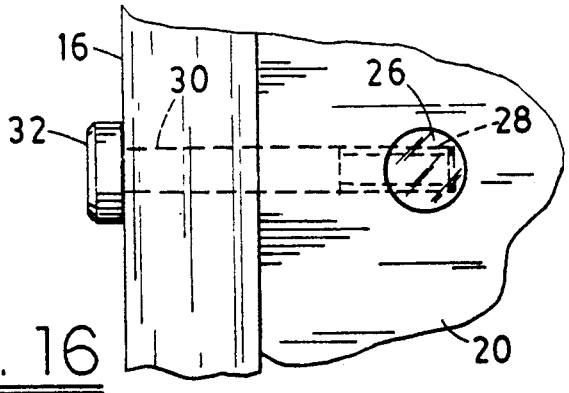
FIG. 16 is a fragmentary plan view of the structure shown in FIG. 15.

A VDT 92 is supported on the table 46 on top of a computer 94 which is located on the table below the VDT 92. Of course, the VDT alone may be disposed on the table 46. A keyboard 96 is disposed on the top of the keyboard shelf 54 and is connected to the computer 94 by a cable 98. As noted above some VDTs (so called "smart terminals") have self-contained computers and may themselves be disposed on the table 46. The position of the VDT and computer towards the front or rear of the workstation is adjusted by means of a vertical panel 100 of the computer table assembly 40. This panel may be of particle board with inserts as shown in FIGS. 14 to 16. Knobs 102 connected to threaded rods (much like the bolts 30) extend through pairs of slots 104 and 106. These slots 104 and 106 are in alignment. By loosening the knobs, the panel 100 may be advanced or retracted so as to advance or retract the VDT so that the screen 101 is at the desired position along the line of sight of the operator.

Figure 10:
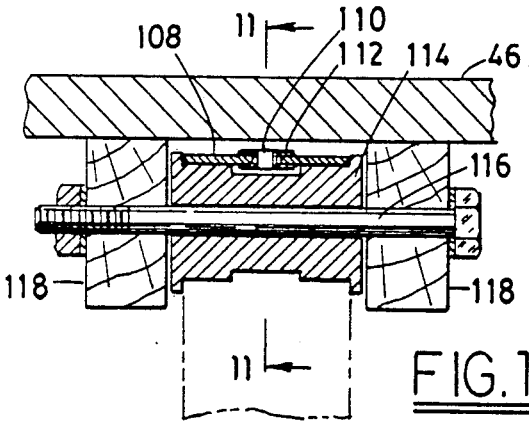
FIG. 10 is an enlarged fragmentary sectional view of the pulley and belt of the computer table inclination mechanism, the view being taken along the line 10—10 in FIG. 11.
Figure 11:
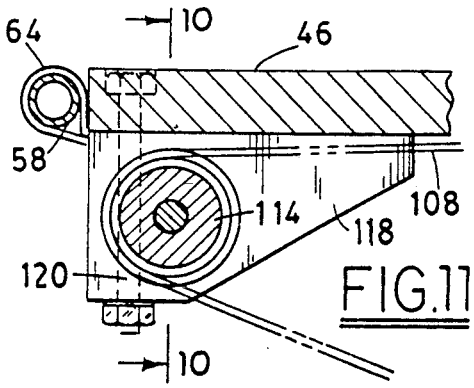
FIG. 11 is an enlarged sectional view showing the mechanism illustrated in FIG. 10, the view being taken along the line 11—11 in FIG. 10.

A mechanism for supporting and inclining (tilting) the computer table 46 and its assembly 44 includes a belt 108 which is attached at one end to the beam 34. The belt has holes 110 which are reinforced by grommets 112. The belt extends around a pulley 114 (see FIGS. 5, 6 and 10) which is journaled on a bolt 116 extending through blocks 118. The blocks are connected to the table 46 by bolts 120 (see FIG. 11). A length of the belt 108 extends between the pulley 114 and the beam 34. By adjusting this length, as will be apparent from FIG. 6, the computer table 46 and its assembly 44 may be tilted as required to locate the screen 101 of the VDT along the line of sight of the operator. Thus, whether the operator is a 5' tall woman or a 6'6" man, both the height and the inclination of the VDT can be adjusted so as to minimize fatigue, especially eye strain.

Figure 5:
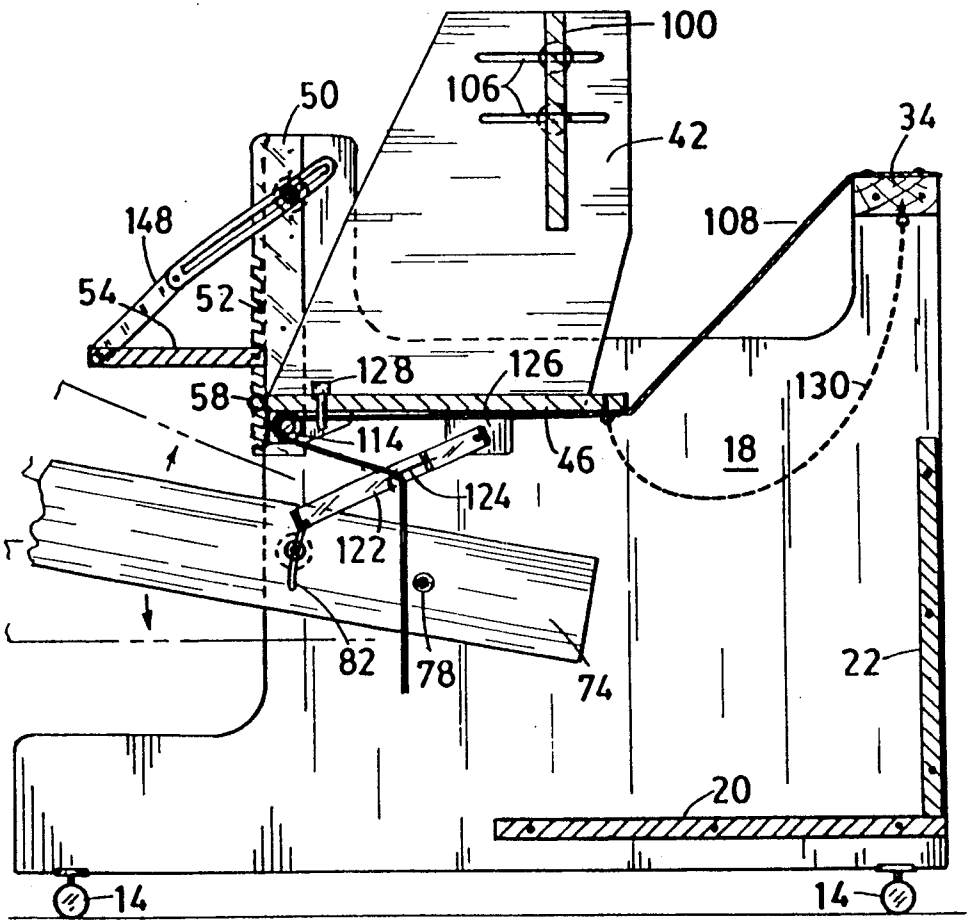
FIG. 5 is a fragmentary sectional view taken along the line 5—5 in FIG. 4.
Figure 4:
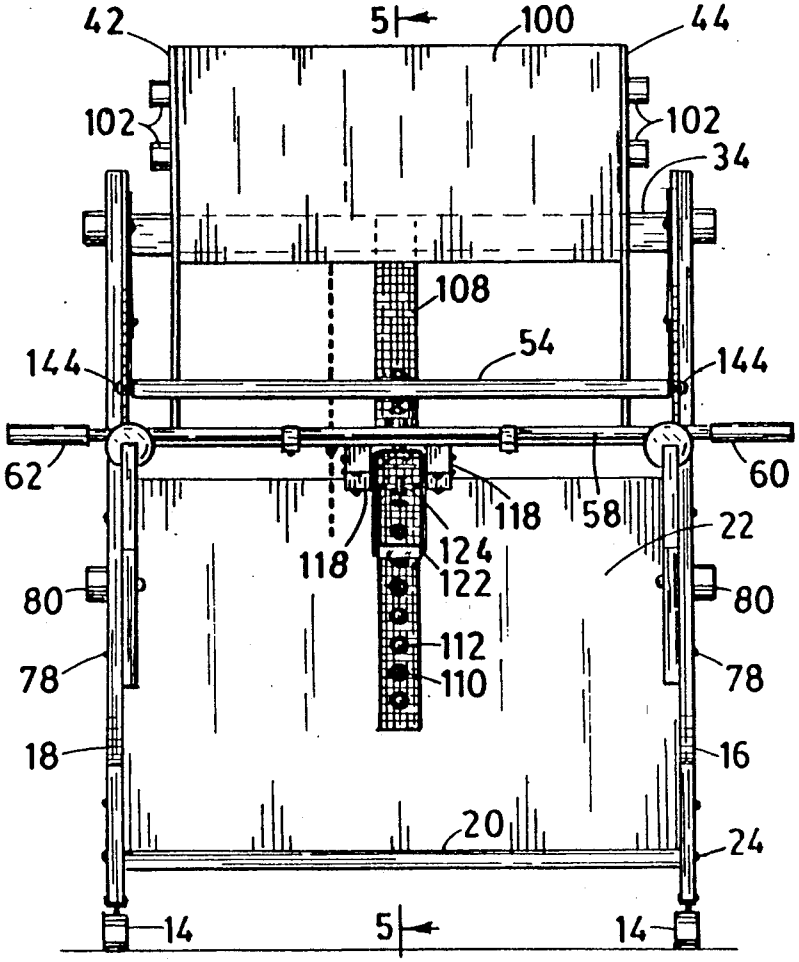
FIG. 4 is a front elevation of the workstation shown in FIG. 1.
Figures 6, 7, 8:
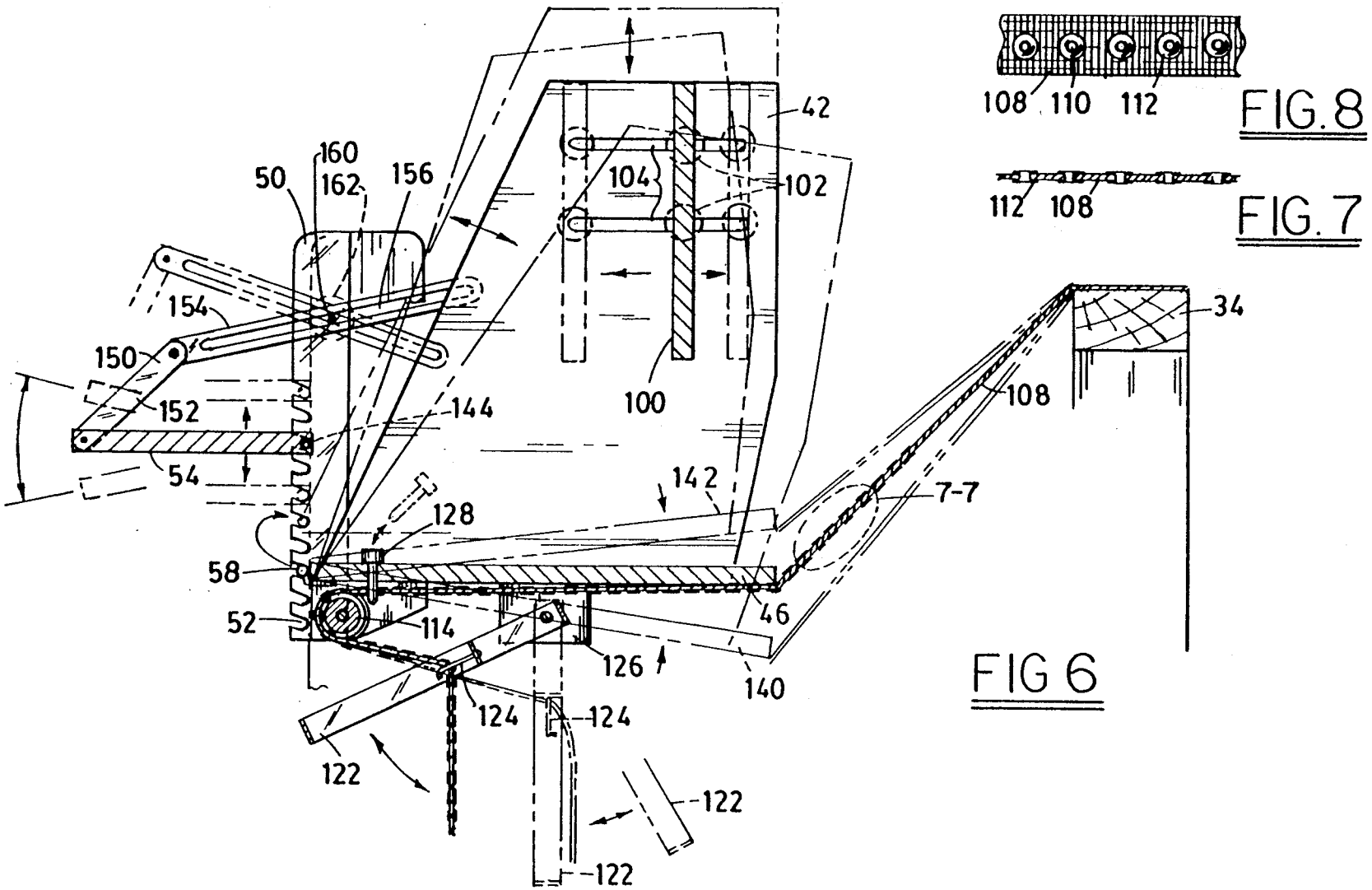
FIG. 6 is a fragmentary sectional view, similar to FIG. 5, showing the computer table mechanism and the keyboard shelf mechanism in various positions during adjustment thereof.
FIG. 7 is an enlarged side elevation of the belt taken along the line 7—7 in FIG. 6.
FIG. 8 is a plan view of the portion of the belt shown in FIG. 7.

The adjustment of inclination is obtained with a handle 122 having a hook 124 (see especially FIGS. 5 and 6). The handle 102 is pivotally mounted in a block 126.

A stop pin 128 is provided for holding the table 46 and the table assembly at the desired angle of inclination. A safety chain 130 is connected between the beam 34 and the table 46 to stop the table from excessively pivoting downwardly to an angle where the computer and/or the VDT can drop beyond a level where the assembly can easily be picked up and readjusted by the operator. This angle of inclination will be above the angle of repose of the computer and the terminal so that it cannot slip backwardly off the table 46.

The adjustment of the computer table 46 and the table assembly 44 will be more apparent from FIG. 6. First the elevation of the table is set by inserting the rod 58 in one of the slots 52 which will set the table at the desired elevation. As can be seen from FIG. 6, the tension force in belt 108 has a rearward horizontal component which secures rod 58 in slots 52 under all possible VDT 92 and computer 94 loaded table assembly 44 locations and orientations. It will be noted that the slots are inclined downwardly so that the forces due to the weight of the table assembly 44 and the VDT 92 and computer 94 thereon will be directed into, rather than out of the slot.

As shown in FIG. 9 the rod may be walked upwardly or downwardly from slots on one side to slots on the other side in a zig zag fashion. This enables an operator who is not strong to readily adjust the elevation of the table 46 and, of course, the computer 94 and VDT 92 thereon.

As shown in FIG. 6, once the elevation of the assembly 44 is set, the hook 124 is located in one of the available belt holes 110. The pin 128 is then removed and the handle pivoted so as to pull or release the belt thereby adjusting the length of the belt underneath the table. When the handle is moved towards the operator, the table tilts down. When the handle is pushed away from the operator, the table is tilted upwardly. Two typical positions are shown at 140 and 42. When the desired angle of inclination is reached, the pin 128 is inserted through a hole in the table which overlies the belt into the closest adjacent hole in the belt. It is noted that the table inclination adjustment mechanism guards against inadvertent release of the table (where the safety chain 130 would come into play), since the stop pin 128 must be inserted into the belt grommets 112 before the operator's hand can be removed from the adjustment handle 122. Also the hook 124 cannot be disengaged from the belt until the safety stop pin 128 has positively engaged the belt.

FIG. 6 also shows how the backing panel 110 can be adjusted with the aid of the knobs 102.

The keyboard shelf 54 is also adjustable in elevation by inserting pins 144 which extend from the side edges of the table near the rear edge thereof into the slots 52 in the racks 48 and 50. The inclination of the keyboard shelf 54 is adjusted by means of link mechanisms 148, 150. These link mechanisms include articulated links 152 and 154. The link 154 has a slot 156. Bolts 160 having knobs 162 extend through the slots 156 and through holes in the legs 36 of the side panels 16 and 18. When these knobs 162 are loosened, the table 154 may be tilted about the pins 144. When held in the desired tilted position, the knobs 162 are tightened to lock the table 154 at the desired angle of inclination. This angle of inclination may, for example, be along the same line of sight to the center of the screen.

It will, therefore, be apparent that the operator can make the following adjustments:

(a) raise, lower or tilt the computer support table 46;

(b) raise, lower or tilt the keyboard shelf 54;

(c) raise or lower the arm rests 70 and 72; and (d) adjust the position of the VDTs screen 101 either toward or away from the operator.

All such adjustments can be made with a low amount of force which can be exerted by a weak operator, for example, about 12 pounds of force. All such adjustments can be made while the operator is seated at the workstation 10.

From the foregoing description, it will be apparent that there has been provided an improved computer workstation. Variations and modifications of the workstation illustrated herein, within the scope of the invention, will undoubtedly suggest themselves to those skilled in the art. The foregoing description should, therefore, be taken as illustrative and not in a limiting sense.

What is claimed is:

1. A workstation for supporting a computer and/or a video display terminal which comprises a frame having sidewalls and a back member extending between said sidewalls, racks having edges with a plurality of slots along one edge of each of said racks said racks being disposed on said sidewalls with said slots of one of said racks laterally aligned with the slots of the other of said racks a table having an upper surface for supporting said terminal, said table having forward and rear edges and having side edges and also having a bottom surface, members connected to said table and extending beyond said side edges, said table being disposed between said sidewalls with each of said members disposed in one of said slots in said rack said members may be disposed in different ones of said slots; to adjust the elevation of said table, said table being pivotally mounted on said members in said slots, and means including a belt connected to said back member of said frame and extending along and in supporting relationship with the bottom surface of said table, for adjusting the inclination of said table.

2. The workstation according to claim 1 wherein said members are comprised of end portions of a rod connected to said table.

3. The workstation according to claim 2 wherein said rod is disposed against said forward edge of said table.

4. The workstation according to claim 1 wherein said inclination adjusting means also comprises a pulley having an axis of rotation paralleling said forward edge of said table and rotatably mounted on the bottom surface of said table, said axis being below said bottom surface, a handle pivotally mounted to said bottom surface of said table, said belt extending around said pulley and having a first portion between said pulley and said back member and a second portion extending beyond said pulley, and means for engaging said second portion of said belt with said handle, said handle being pivoted to change the length of said first portion thereby changing the inclination of said table.

5. The workstation according to claim 4 wherein said belt has a plurality of holes spaced from each other along said belt, said means for engaging said belt including a hook on said handle extending into a selected one of said holes.

6. The workstation according to claim 5 wherein said inclination adjusting means further comprises a hole through said table overlying said belt, and a pin removably disposed in said hole and extending into one of said holes for holding said belt to maintain said table at a selected inclination.

7. The workstation according to claim 1 wherein said computer has a keyboard, a shelf having the surface for supporting said keyboard and also having forward, rear and side edges, means pivotally supporting said shelf forwardly of said terminal supporting table at selected elevations and inclinations with respect to said terminal supporting table.

8. The workstation according to claim 7 wherein said means for pivotally supporting said shelf comprises projections from the side edges of said shelf and positioned in the slots of said racks selected in accordance with the desired elevation of said shelf, and links pivotally connecting said shelf to said side walls for pivoting said shelf about said projections said links adjusting the inclination of said shelf.

9. The workstation according to claim 7 further comprising a pair of arm rest members, each of said armrest being pivotally connected to one of said sidewalls and extending in a forward direction past said terminal supporting table and said shelf, and means for positioning said arm rest members at selected inclinations.

10. The workstation according to claim 1 further comprising a backing panel movably attached to said sidewalls and extending therebetween, said backing panel being disposed above said terminal supporting table.

11. The workstation according to claim 10 wherein said sidewalls have pairs of slots, a pair of said slots in one of said sidewalls being in alignment with a second pair of said slots in the other of said sidewalls, and knob means outside said sidewalls and extending through said slots into said backing panel for holding said backing panel in a selected position along said slots.

* * * * *